US005704876A

United States Patent [19]

Baatz

[11] Patent Number: 5,704,876

[45] Date of Patent: Jan. 6, 1998

[54] WHEELCHAIR AEROBIC EXERCISE TRAINER

[75] Inventor: Wilfried Baatz, Seattle, Wash.

[73] Assignee: Racer-Mate, Inc., Seattle, Mass.

[21] Appl. No.: 673,226

[22] Filed: Jun. 28, 1996

[51] Int. Cl.[6] ..... A63B 22/00

[52] U.S. Cl. ..... 482/4; 482/54; 482/61

[58] Field of Search ..... 482/1–4, 54, 57–65, 482/901, 902, 148

[56] References Cited

U.S. PATENT DOCUMENTS

| | | | |
|---|---|---|---|
| 2,735,422 | 2/1956 | Jones | 482/60 |
| 4,966,362 | 10/1990 | Ramaekers | 482/54 |
| 5,042,795 | 8/1991 | Bursik | 482/65 |
| 5,368,546 | 11/1994 | Stark | 482/902 |
| 5,476,429 | 12/1995 | Bigelow et al. | 482/54 |

OTHER PUBLICATIONS

Clinic Report; "Research Device to Preproduction Prototype: A Chronology," Department of Veterens Affairs, *Journal of Rehabilitation Research and Development*, vol. 30, No. 4, 1993, pp. 436–442.

Advertisement; "D&J Wheelchair Computrainer," D&J Development Workshop and Racermate, INc., *Sports 'n Spokes*, Mar./Apr., 1996, p. 42.

*Primary Examiner*—Richard J. Apley
*Assistant Examiner*—Glenn E. Richman
*Attorney, Agent, or Firm*—Christensen O'Connor; Johnson & Kindness PLLC

[57] ABSTRACT

An aerobic wheelchair trainer (10) is provided. The wheelchair trainer includes a ramp (12) having a plurality of level steps (24–28). The steps lead a wheelchair inserted into the wheelchair trainer onto a platform (13). The wheelchair trainer also includes a support mechanism (16) that supports the weight of the wheelchair (22) and wheelchair occupant. A load mechanism (18) including a resistance roller (70) and an eddy current brake (110) is also included. The load mechanism provides a variable resistance to movement of the wheels (20) of the wheelchair. The wheelchair trainer (10) also includes a lift mechanism (14) that lifts the rear end of the wheelchair up and into or out of the support mechanism (16). The load mechanism (18) is connected to a controller (144). The wheelchair trainer (10) may be used either individually or may be connected to another compatible wheelchair trainer (10) over a phone line (152).

25 Claims, 7 Drawing Sheets

107
76
120
107
122
106
126
130
142
128
143
138
132
136
140
143
134
110
142
124

WHEELCHAIR AEROBIC EXERCISE TRAINER

FIELD OF THE INVENTION

The present invention relates to aerobic fitness training equipment for wheelchair occupants.

BACKGROUND OF THE INVENTION

The benefits of consistent aerobic exercise have been well documented by the medical field. In order to assist people in achieving aerobic fitness, the developers of exercise equipment have come out with numerous aerobic trainers including rowing machines, bicycles, treadmills, stairmasters, etc. Most of the currently existing aerobic exercise equipment is not correctly configured for use by individuals confined to the use of wheelchairs.

There has long been a need for an aerobic fitness trainer that can be used by an occupant of a wheelchair. A major focus of the Department of Veterans Affairs research has been to design an aerobic fitness trainer that can be used by a wheelchair occupant. See "Research Device to Preproduction Prototype: A Chronology," *Journal of Rehabilitation Research and Development*, Vol. 30, No. 4, 1993, pages 436–444. One of the goals of past research has been to design a wheelchair fitness trainer that simulates the range of stress and aerobic fitness required by an occupant to propel a wheelchair during normally daily use. Thus, a substantial portion of prior research has focused upon an aerobic fitness trainer that could be used directly with a wheelchair. A number of prior aerobic fitness trainers include one or more resistance rollers that are located underneath the wheels of the wheelchair. As the occupant moves the wheels of the wheelchair, the rollers provide a rolling resistance to the wheels' movement, thus producing a simulated load on the wheelchair and occupant.

It is important that a wheelchair trainer provide the wheelchair occupant a realistic load that simulates real life use of a wheelchair. It would also be advantageous if such a trainer could simulate various terrain and wheelchair operational speeds. Further, to be generally accepted in the market place, it is important that such an aerobic trainer be capable of use with wheelchair occupants of all different sizes, physical fitness and physical disability.

Prior aerobic wheelchair trainers have generally locked the wheelchair into a frame such that the weight of the wheelchair and occupant are supported by a resistance roller that is located directly underneath the wheels of the wheelchair. Because the entire weight of the wheelchair and occupant are placed on the resistance roller, a large magnitude off fiction is developed between the wheels of the wheelchair and the resistance roller. A strong, physically fit wheelchair occupant can overcome this resistance in order to turn the wheels of the wheelchair. However, a new wheelchair occupant or less physically fit wheelchair occupant often finds it difficult or impossible to use such a wheelchair trainer. The resistance developed between the wheels of the wheelchair and the resistance roller in such wheelchair trainers can often be greater than the resistance developed during actual use of the wheelchair. Thus, such wheelchair trainers often do not provide the occupant a realistic aerobic workout.

In addition, such wheelchair trainer designs also have other disadvantages. Due to the large magnitude of resistance between the wheels of the wheelchair and resistance roller, the wheels of the wheelchair do not continue to rotate after the occupant releases the wheels in a manner similar to that experienced during actual use of the wheelchair. After the occupant releases the wheels, the resistance between the wheels and the roller quickly stops the rotation of the wheels.

Generally, prior aerobic wheelchair trainers have been specifically designed to accommodate certain types of wheelchairs. Thus, if the wheelchair trainer's user purchases a new or different type of wheelchair, special adaptive brackets may be required or the new wheelchair may not be able to be used with the wheelchair trainer. The difficulty of adapting aerobic wheelchair trainers to accommodate differing wheelchairs is complicated by the many different types and configurations of wheelchairs available on the market today. Many of such wheelchairs are custom designed and specially fit to the individual occupant. Adjustments on such wheelchairs often include changing the positioning and tilt of the wheels. In addition, different wheelchair configurations are available for different uses. Wheelchairs designed for racing differ substantially from wheelchairs designed for general use or wheelchairs designed for basketball, tennis, etc.

In addition to differing wheelchair configurations causing mounting problems, changing wheelchair configurations also limit the use of prior wheelchair trainers in other manners. Differing the position and tilt or slant of the wheels of the wheelchair dramatically changes the rolling resistance produced between the wheels of the wheelchair and the roller of the wheelchair trainer. The greater the tilt or slant of the wheels, the greater the rolling resistance produced between the wheels and the resistance roller. Prior wheelchair trainers do not provide sufficient adjustments to adjust the resistance produced between the wheelchair wheels and roller to account for changing wheelchair configurations.

In addition to not accounting for changing wheelchair configurations, prior wheelchair trainers do not sufficiently account for the varying levels of physical fitness and level of disability of different wheelchair occupants. One of the major desires of wheelchair occupants is a wheelchair trainer that can be used without a need for any assistance from another individual. Past wheelchair trainers require varying levels of assistance to be provided by another individual prior to use. For example, some wheelchair trainers require that another person mount the wheelchair within the wheelchair trainer and then assist the wheelchair occupant into the wheelchair trainer prior to use. Other wheelchair trainers allow the wheelchair occupant to move the wheelchair onto the wheelchair trainer under their own power. However, such trainers required assistance in locking and unlocking the wheelchair from within the wheelchair trainer. Although some wheelchair trainers have eliminated the majority of assistance required for a very physically fit wheelchair occupant, they still require significant assistance for wheelchair occupants that are not physically fit or that have more severe disabilities.

As can be seen from the discussion above, there exists a need for an improved wheelchair trainer that overcomes some of the disadvantages of prior wheelchair trainers. The present invention is directed towards fulfilling part of this need.

SUMMARY OF THE INVENTION

The present invention is an aerobic wheelchair trainer. The wheelchair trainer may be used by a wheelchair occupant without additional assistance from other individuals.

One embodiment of the wheelchair trainer includes a platform that is adapted to receive a wheelchair. A support mechanism is coupled to the platform and supports the majority of the weight of the wheelchair and a wheelchair occupant when the wheelchair is placed onto the platform. A retractable stair or lift mechanism coupled to the platform allows the wheelchair occupant to maneuver the wheelchair into and out of the support mechanism without the help of another individual. The wheelchair trainer also includes a load mechanism that engages the wheels of the wheelchair and adds a variable resistance to rotation of the wheels thereby allowing the wheelchair occupant to achieve an aerobic workout.

In accordance with other features of the invention, the wheelchair trainer includes a ramp that is attached to the front of the platform. The ramp includes a series of steps that allow the wheelchair occupant to maneuver the wheelchair up the ramp onto the platform.

According to still other aspects of the invention, the load mechanism includes a resistance roller that engages both wheels of the wheelchair. The ends of the resistance roller may be independently adjusted to adjust the amount of force applied to the wheels of the wheelchair by the resistance roller.

In accordance with still other aspects of the invention, the support mechanism includes two pillars that extend upward from the surface of the platform. Axle supports are mounted on the upper end of the pillars and are configured to support the axles of the wheelchair. The axle supports include ball supports that engage and support balls mounted on the axles of the wheelchair.

In accordance with still other aspects of the invention, the retractable stair or lift mechanism includes opposing lift arms that are mounted to the platform and a lift bar that is located under the wheels of the wheelchair. Upward and downward movement of the lift arms causes a corresponding upward and downward movement of the lift bar. A handle and drive shaft are rotatably connected to the lift arms. A wheelchair occupant's rotation of the handle causes the lift arms and thus lift bar to move up or down, thus raising or lowering the wheelchair.

In accordance with other features of the invention, the load mechanism includes an eddy current brake, a controller, a display and a modem. The eddy current brake is controlled by the controller to vary the resistance that the roller provides to rotation of the wheels of the wheelchair. The controller also provides a signal to the display to provide the user an indication of performance. The controller may also be connected to the controller of another wheelchair trainer through the modem in order to provide the user an indication of performance with respect to a wheelchair occupant using the other wheelchair trainer.

The aerobic wheelchair trainer of the present invention provides numerous advantages over prior art wheelchair trainers. First, the present invention's use of a stepped ramp as opposed to an inclined ramp allows wheelchair occupants of various physical conditions to use the wheelchair trainer. Unlike inclined ramps used in past wheelchair trainers, the stepped ramp of the invention allows the wheelchair occupant to rest after climbing over each individual step. This stepped-ramp feature allows less capable wheelchair occupants to maneuver a wheelchair into the wheelchair trainer without any assistance from another individual.

The wheelchair trainer of the present invention may also be easily reconfigured to allow various wheelchair configurations to be used within the trainer. The invention's use of support balls mounted on the interior of the wheel axles of existing wheelchairs combined with a support mechanism allows a wide variety of wheelchair configurations to be used.

The present invention's use of a wheelchair support mechanism to support the majority of the weight of the wheelchair and wheelchair occupant also produces advantages over prior wheelchair trainers. Allowing the wheelchair trainer to support the majority of the weight of the wheelchair and occupant allows the resistance to movement of the wheelchair wheels to be precisely adjusted. Thus, the wheelchair trainer of the invention can place from no additional resistance to a large magnitude of additional resistance on the rotation of the wheels of the wheelchair. The invention's ability to individually adjust both sides of the resistance roller also allows the invention to carefully take into account varying wheel sizes, wheel pressures, etc., to achieve the most advantageous results.

One of the most beneficial advantages of the present invention is the ability to allow a wheelchair occupant to use the wheelchair trainer without any assistance from another person. The wheelchair occupant can back the wheelchair into the wheelchair trainer and adjust the resistance to the movement of the wheels of the wheelchair entirely by themselves.

In addition to the numerous advantages discussed above, the wheelchair trainer of the present invention also includes motivational features to assist the wheelchair occupant in obtaining a good aerobic workout. The present invention provides feedback regarding the wheelchair occupant's performance and also allows the wheelchair occupant to compete against either simulated or human competitors via the phone system or possibly Internet.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
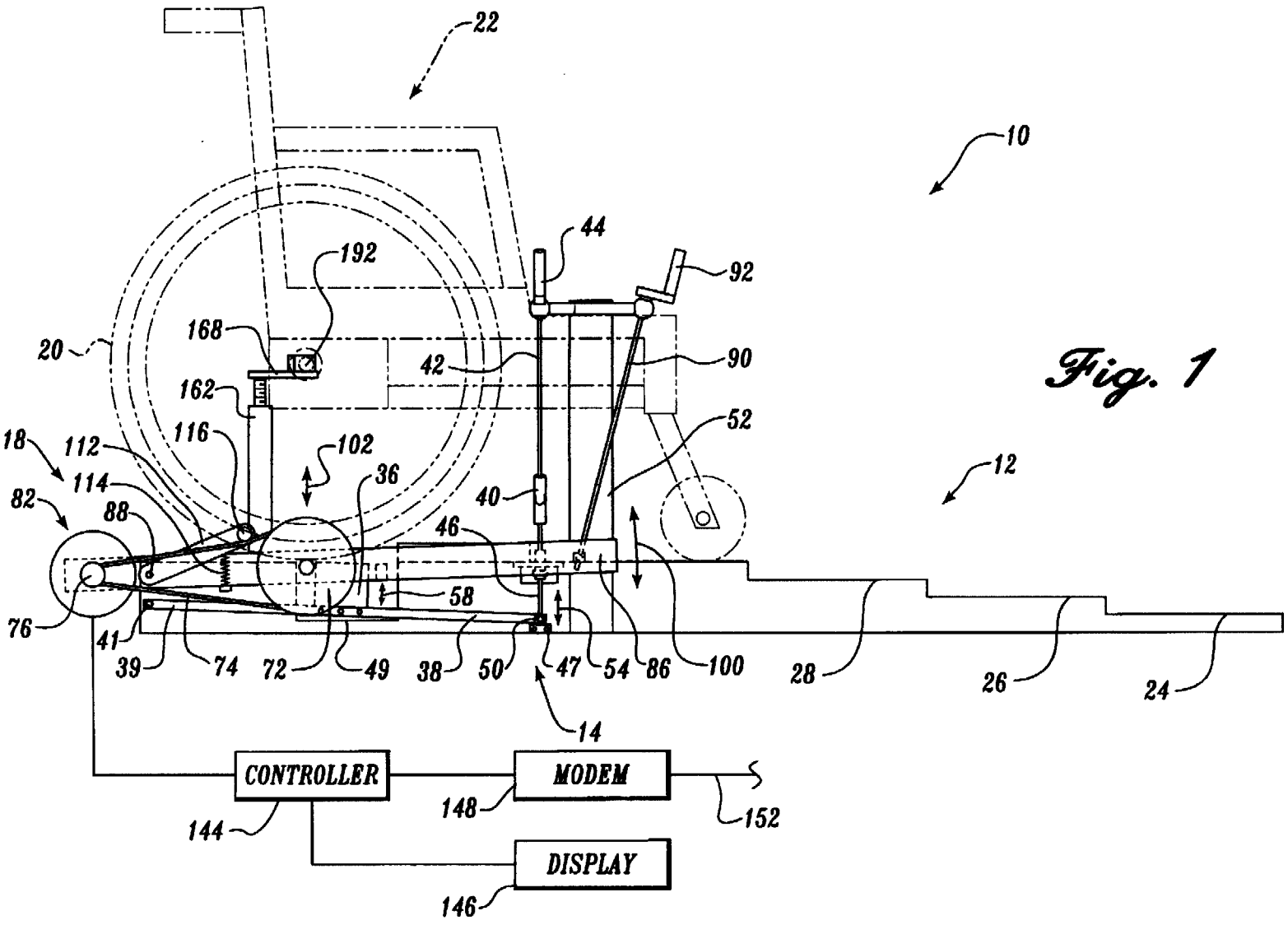
FIG. 1 is a side elevation view of a preferred embodiment of a wheelchair trainer according to the present invention.

A preferred embodiment of a wheelchair trainer 10 according to the present invention is illustrated in FIG. 1. The wheelchair trainer 10 includes a wheelchair ramp 12, a wheelchair platform 13 (FIG. 3), a retractable stair or mechanism 14 (FIGS. 1 and 5) for positioning the wheelchair into the wheelchair trainer, a support mechanism 16 (FIG. 7) for supporting the weight of the wheelchair within the wheelchair trainer, and a load mechanism 18 (FIGS. 1 and 4) for placing a load on the drive wheels 20 of a wheelchair 22 that is located within the wheelchair trainer.

The ramp 12 (FIG. 1) is mounted directly in front of the platform 13 and is used to assist an occupant of the wheelchair 22 in backing the wheelchair into the wheelchair trainer 10. Although the ramp 12 may be inclined, the ramp preferably includes a plurality of level stairs or steps 24, 26 and 28 that assist the occupant of the wheelchair in lifting the wheelchair 22 up to the correct height to be placed within the wheelchair trainer 10. In prior wheelchair trainers, a wheelchair occupant had to wheel the wheelchair trainer up an inclined ramp having a relatively constant slope. Such a slope is difficult for a wheelchair occupant to roll a wheelchair over unless the wheelchair occupant is in peak physical condition. As soon as a wheelchair occupant lets go of the drive wheels 20 of the wheelchair, the wheelchair tends to roll back down the inclined ramp.

The present invention's use of a series of level steps 24–28 allows the wheelchair occupant to slowly and sequentially raise the wheelchair 22 to the height required to move the wheelchair into the wheelchair trainer 10. In order to back the wheelchair 22 up over the steps 24–28, the wheelchair occupant rotates the drive wheels 20 counterclockwise (FIG. 1) so that the drive wheels 20 roll up onto the step 24. Once the drive wheels 20 are on top of the first step 24, the wheelchair occupant may let go of the drive wheels 20 and the wheelchair 22 remains in its position on top of the first step. The wheelchair occupant may then rest or immediately reposition their hands on the drive wheels 20 in order to rotate the drive wheels 20 further counterclockwise so that the drive wheels rotate up onto the second step 26. The wheelchair occupant continues the counterclockwise rotation of the drive wheels 20 until the wheelchair 22 rests on top of the platform 13 forming the upper surface of the wheelchair trainer 10.

The wheelchair retractable stair or lift mechanism 14 (FIGS. 1 and 5) includes a lift bar 36, opposing lift arms 38, a universal 40, a drive shaft 42, a crank handle 44, opposing driven shafts 46, opposing shaft supports 47 (FIG. 1), and a belt or chain drive 48.

Figure 5:
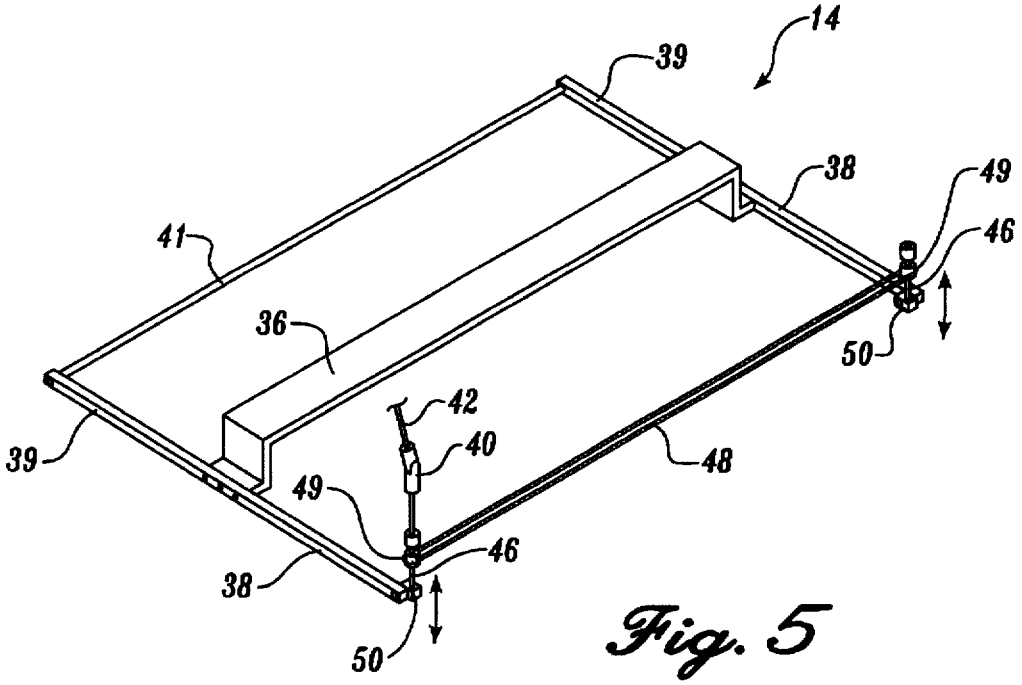
FIG. 5 is a perspective view of the lift mechanism.

The lift bar 36 is an elongate square beam that is mounted within a recess 49 (FIG. 1) that extends downward from the top of the platform 13 approximately across the width of the platform 13. The opposing ends of the lift bar 36 (FIG. 5) are connected to a midpoint of the opposing lift arms 38 (FIGS. 1 and 5). The left ends 39 of the lift arms 38 are pivotally attached to the opposing sides of the platform 13 using pivot 41. The right ends 43 of the lift arms 38 are connected to the lower ends of the opposing driven shafts 46. The lower ends of the driven shafts 46 are pivotally connected to the right ends 43 of the lift arms 38 using pivot blocks or pins 50 that extend through bores in the right ends 43 of the lift arms. The pivot pins 50 are rotatably mounted within the right ends 43 of the lift arms and include a centrally located bore that extends through the midsection of the pivot pins (FIG. 1). The lower ends of the opposing driven shafts 46 are threaded through the bores that extend through the pivot pins 50. The lower portions of the driven shafts 46 that extend through the pivot pins 50 rest upon the upper surface of the shaft supports 47. The shaft supports 47 are rigidly attached to the opposing side of the platform 13.

Figure 3:
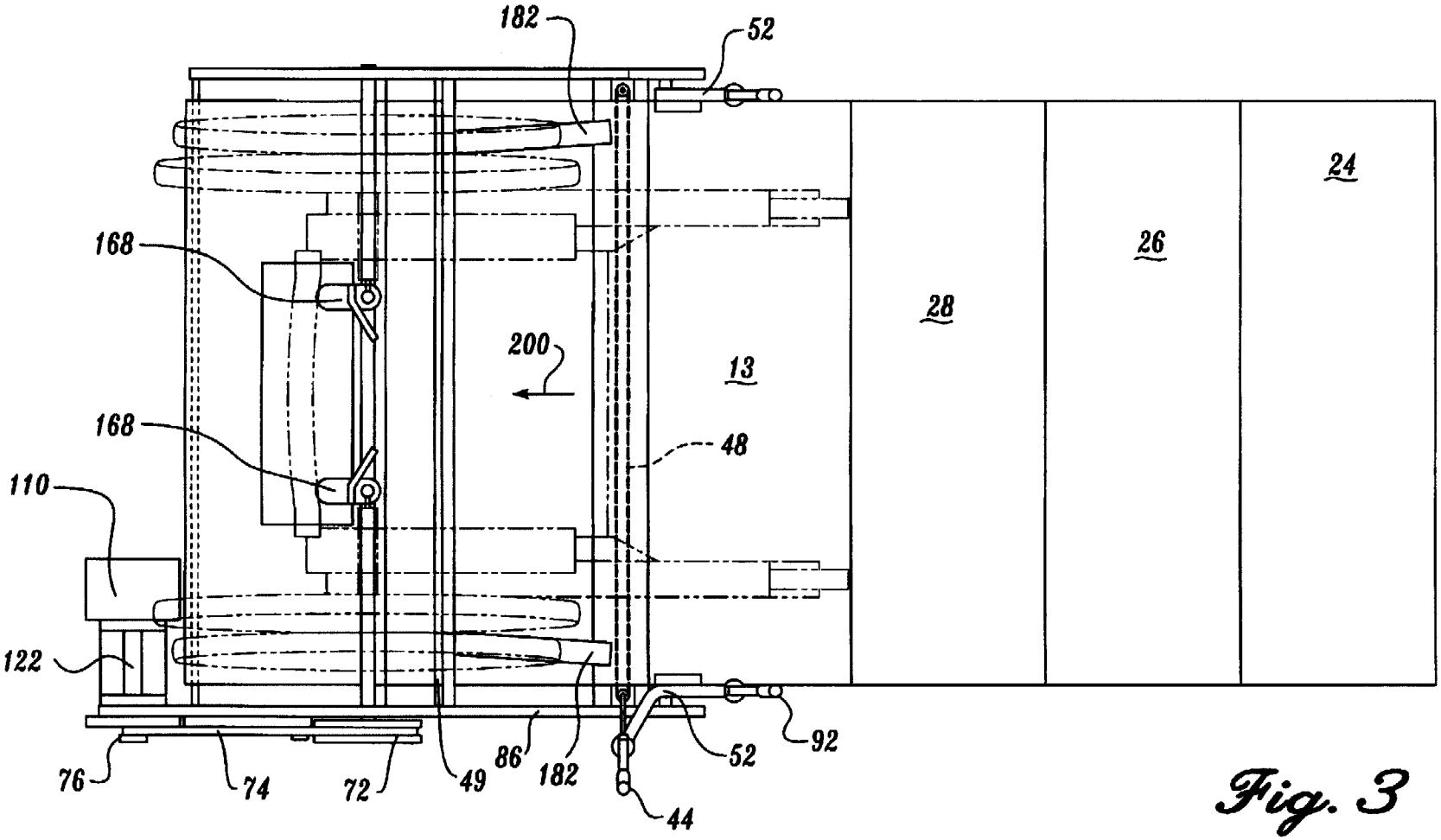
FIG. 3 is a top view of the wheelchair trainer of FIG. 1.

The opposing driven shafts 46 are connected together by the chain drive 48 (FIGS. 3 and 5). The driven shafts 46 include drive gears or sprockets 51 that engage the chain drive 48. The chain drive 48 extends across the width of the platform 13 around the gears or sprockets 51 mounted on the opposing driven shafts 46 so that rotation of one of the driven shafts 46 results in a corresponding rotation of the opposite driven shaft.

Figure 2:
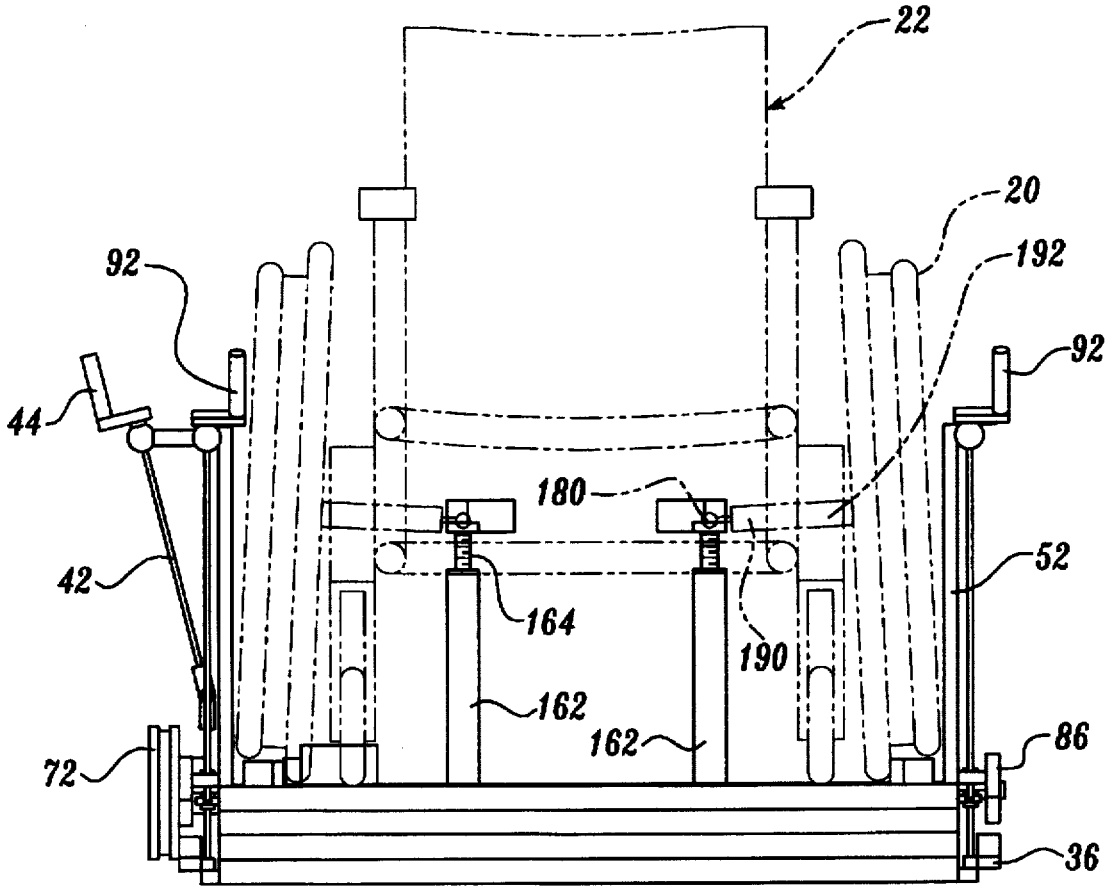
FIG. 2 is a front view of the wheelchair trainer of FIG. 1.

The upper end of the fight driven shaft 46 as illustrated in FIGS. 2, 3 and 5(when looking from the rear of the wheelchair trainer forward) is connected to the lower end of the drive shaft 42 through the use of the universal 40. The drive shaft 42 extends upward and outward from the top of the driven shaft 46 (FIGS. 1 and 2) and its upper end is rotatably mounted within the upper end of a left support pillar 52. The left and fight support pillars 52 extend upward from the right and left sides of the platform 13. The upper end of the drive shaft 42 extends through a bore in the fight support pillar 52 so that the drive shaft is rotatably mounted within the support pillar. The upper end of the fight drive shaft 42 extends through the top of the right support pillar 52 and is connected to the crank handle 44 (FIG. 1).

Rotation of the crank handle 44 causes rotation of the drive shaft 42 which in terms causes rotation of the fight driven shaft 46. As the fight driven shaft 46 rotates, it causes the left driven shaft 46 on the opposite side of the platform 13 to rotate in a corresponding direction through rotation of the chain drive 48. As the opposing driven shafts 46 rotate, they rotate within the threaded pivots 50 connected to the fight ends of the lift arms 38. The rotation of the opposing driven shafts 46 causes the fight ends 43 of the lift arms 38 to be threaded upward off of the shaft supports 47 as illustrated by arrow 54 (FIG. 1) so that the lift arms pivot counterclockwise about the pivots 41. Alternatively, depending on the direction of rotation of the driven shafts 46, the right ends of the lift arms 38 move downward as illustrated by arrow 54, so that the lift arms 38 rotate clockwise about the pivots 41. As the opposing lift arms 38 rotate clockwise or counterclockwise about pivots 41, they raise or lower the lift bar 36 as illustrated by arrow 58. The upward and downward movement of the lift bar 36 raises and lowers the wheels 20 and thus, the back end of the wheelchair 22 in order to position the wheelchair within the wheelchair trainer as described in detail below.

The load mechanism 18 (FIG. 1) includes a roller 70, drive pulley 72, drive belt 74, driven pulley 76, belt tensioner 80, opposing adjustment shafts 90, handles 92, a load mechanism 82, opposing adjustment arms 86 and a crossbrace 87. The roller 70 is rotatably mounted within the recess 49 (FIG. 6) that extends downward from the top of the platform 13 directly behind the lift bar 36. The opposing ends of the roller 70 are rotatably mounted within the midpoints of the opposing adjustment arms 86. The adjustment arms 86 are located on the opposing sides of the platform 13 and are pivotally mounted at their left ends to the left end of the platform 13 using pivots 88. The fight ends of the adjustment arms 86 are connected to and supported by the adjustment shafts 90.

Figure 4:
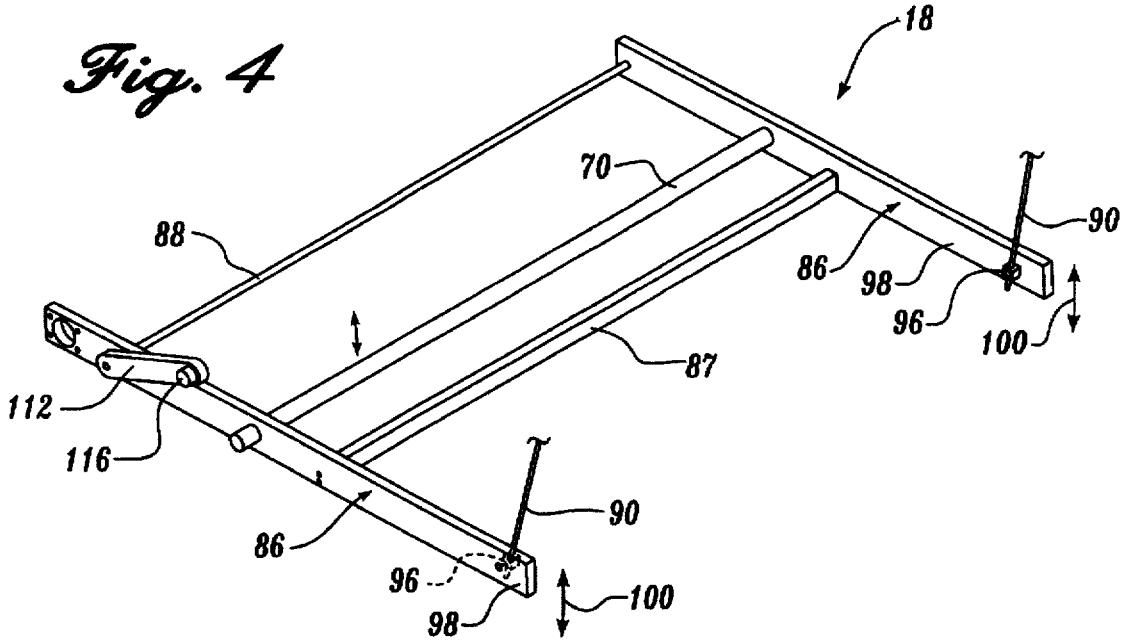
FIG. 4 is a perspective view of a portion of the load mechanism.
Figure 6:
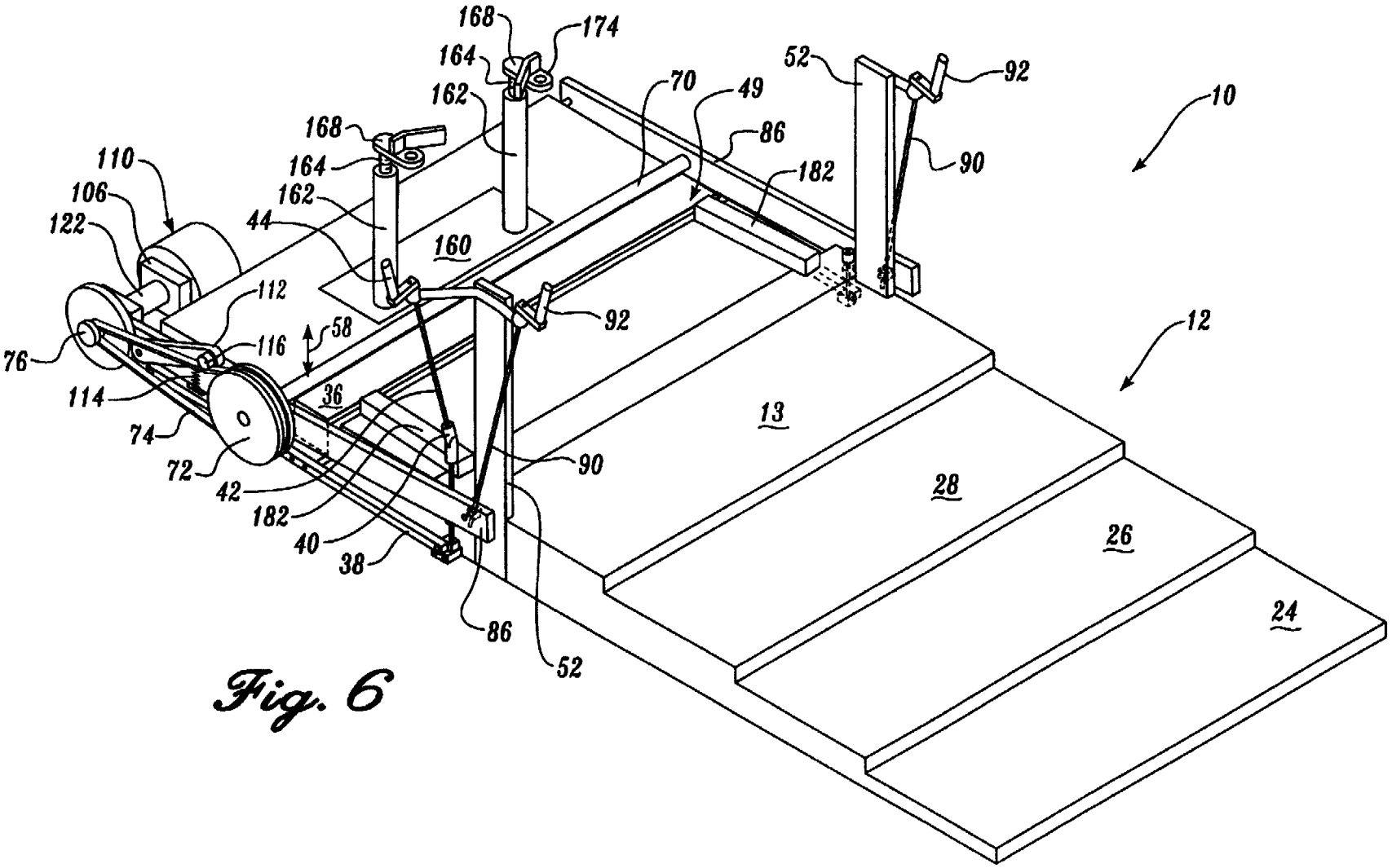
FIG. 6 is a perspective view of the wheelchair trainer of FIG. 1.

The lower ends 94 of the adjustment shafts 90 are threaded into rotatably mounted pivots 96 that are mounted on the right ends 98 of the adjustment arms 86. The adjustment shafts 90 extend upward from the adjustment arms 86 and the upper ends of the adjustment shafts are rotatably mounted within the top of the pillars 52 as best illustrated in FIGS. 1 and 6. The handles 92 are mounted on the upper ends of the adjustment shafts. Rotation of the adjustment shafts 90, using the handles 92, causes the threaded lower ends 94 of the adjustment shafts to be threaded into or out of the pivots 96. This rotational threading of the adjustment shafts 90 within the pivots 96 in turn causes the pivots and thus, fight ends 98 of the adjustment arms 38, to rotate clockwise or counterclockwise about the pivots 88 as illustrated by arrow 100 (FIG. 4). As the adjustment arms 86 rotate clockwise or counterclockwise about the pivot 88, the roller 70 moves upward or downward as illustrated by arrow 102. This upward or downward movement causes the roller 70 to place an increasing or decreasing force on the lower portion of the wheels 20 thus adjusting the resistance between the roller 70 and wheels as described in more detail below. The adjustment shafts 90 may be individually rotated allowing the inclination of the roller 70 to be adjusted at both ends thus allowing the adjustment arms 86 to take into account varying wheel sizes, tire pressures, etc., as described in more detail below.

The cross-brace 87 (FIG. 4) is located in the recess 49 directly in front of the lift bar 36. The cross-brace 87 extends across the width of the platform 13. The opposing ends of the cross-brace are connected to the opposing adjustment arms 86 in order to provide additional stiffness and strength to the structure of the load mechanism.

The drive pulley 72 is mounted to the fight end of the roller 90 as illustrated in FIGS. 1 and 6. The load mechanism 82 is mounted on the left rear comer of the fight adjustment arm 86 using a U-shaped support bracket 106. The load mechanism 82 includes an eddy current brake 110 that is connected to the driven pulley 76 by a shaft 122. The drive pulley 72 and driven together by connected together by the drive belt 74 that extends around the two pulleys 72 and 76.

The drive belt 74 is kept at a proper tension by the belt tensioner 80. The belt tensioner 80 includes a tension arm 112, tension spring 114, and a tension roller 116. The left end of the tension arm 112 is pivotally connected to the platform at pivot 88 (FIG. 1). The tension roller 116 is rotatably mounted on the right end of the tension arm 112 and is positioned directly above and in contact with the drive belt 74 when in operation as best illustrated in FIG. 1. The tension spring 114 is connected between the fight adjustment arm 38, and a midpoint of the tension arm 112, to provide a downward directed force that pulls the tension roller 116 into contact with the drive belt 74. The belt tensioner 80 maintains a slight tension on the drive belt 74 during operation of the wheelchair trainer.

Figure 9:
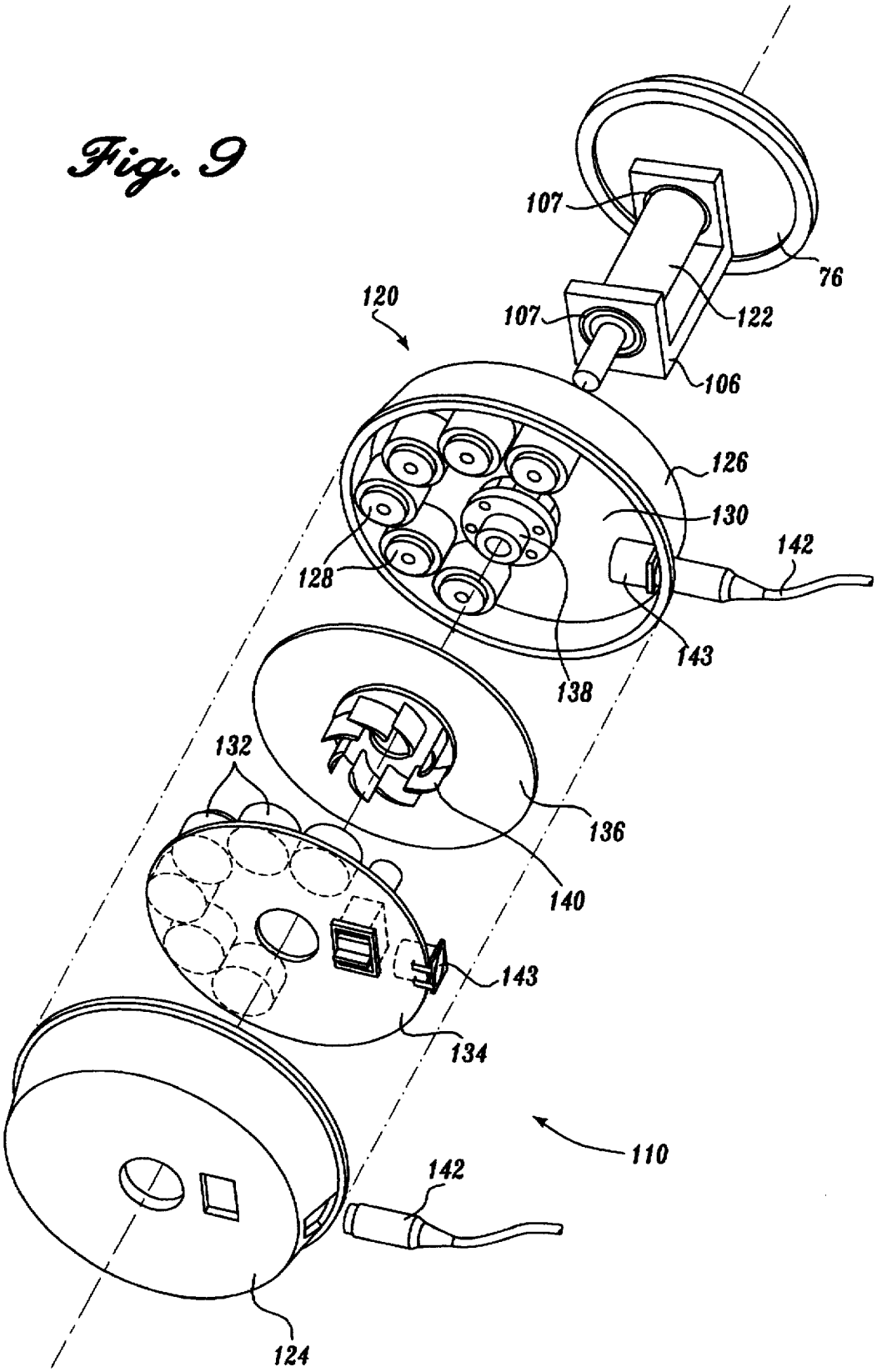
FIG. 9 is an exploded view of the eddy current brake.

The eddy current brake 110 includes a housing 120 (FIG. 9) in which the mechanics and electronics for the eddy current brake are located. The housing 120 is connected to the support bracket 106. The shaft 122 extends through the eddy current brake and through the arms of the support bracket 106 and is rotatably mounted within the arms of the support bracket by bearings 107. The driven pulley 76 is mounted on the end of the shaft 122 opposite the eddy current brake 110.

The housing 120 is formed of an outer cylindrical housing 124 that is joined to a correspondingly sized inner cylindrical housing 126 by bonding, fasteners, etc. The shaft 122 extends through the inner housing 126 into the interior of the housing 120. In the preferred embodiment, six cylindrical electromagnets 128 are mounted on a supporting circuit board disk 130 attached to the inner surface of the inner housing 126. The electromagnets 128 are distributed around the circumference of the circuit board 130 and thus around the portion of the shaft 122 extending into the housing 120. An opposing set of six electromagnets 132 is mounted on a supporting circuit board 134 attached to the inner surface of the outer housing 124. The electromagnets 132 are mounted directly opposite the corresponding electromagnets 128.

A nonmagnetic, electrically conductive circular disk 136 is mounted on the shaft 122 between the opposing sets of electromagnets 128 and 132. The disk 136 is supported on the shaft 122 by a cylindrical support bracket 138 on one side and by a cylindrical fan 140 on the other side. The fan 140 includes a plurality of fan blades that extend outward from the surface of the disk 136. As the shaft 122, and thus disk 136 and fan 140 rotate, the fan produces a flow of air that cools the disk, electromagnets and electronics within the eddy current brake 110.

The opposing sets of electromagnets 128 and 132 are connected to an electrical drive circuit (not shown) located on the supporting circuit boards 130 and 134. The electrical drive circuit is in turn connected to a power source by an electrical cable 142. The electrical cable 142 plugs into a female connection 143 on the circuit board 134 on one end and into a wall outlet on the other end. The electrical drive circuit is also connected to a controller 144 such as a computer by electrical cable 150. The electrical drive circuit energizes the opposing electromagnets 128 and 132 at predetermined times and power levels to produce magnetic fields between the opposing sets of magnets 128, 132. As the disk 136 rotates within the magnetic fields produced by the electromagnets 128, 134, the electromagnets produce eddy currents within the disk. The interaction between the electromagnetic fields produced by the eddy currents within the disk 136, and the magnetic fields produced by the electromagnets 128 and 132, creates a torque or resistance to the rotation of the shaft 122, pulleys 72 and 76, and thus, roller 70.

The structure and operation of the electrical drive circuit and electromagnets 128 and 132 are well known to those of ordinary skill in the art. It would be readily understood by one of ordinary skill in the art how to construct an appropriate electrical drive circuit and opposing sets of electromagnets 128 and 132. Although the structure and operation of the preferred embodiment of the eddy current brake is briefly described above, different designs could be readily used in place of the configuration shown.

The torque or resistance produced by the eddy current brake 110 may be increased or decreased in order to change the resistance provided by the roller 70 and thus simulate changes in speed, terrain, etc., as described in more detail below. For example, the controller 144 may be used to adjust the power energizing the electromagnets 128, 132, thus adjusting the amount of torque or resistance produced by the eddy current brake 110. Eddy current brakes based on controlled power electromagnets are commercially available and sold under the trademark COMPUTRAINER™ by Racer-Mate, located at 3016 Northeast Blakeley Street, Seattle, Wash. 98105. Such eddy current brakes include programmable controllers that allow varying resistances to be programmed into the electrical control circuit.

The support mechanism 16 (FIGS. 7) is mounted on top of the platform 13 immediately behind the roller 70 and is centered with respect to the opposing sides of the platform. The support mechanism 16 includes a base plate 160, two pillars 162 that are spaced apart over the width of the platform 13, two adjustment screws 164, and two axle supports 168. The base plate 160 provides support for the pillars 162 and is firmly attached to the upper surface of the platform 13.

The pillars 162 are mounted to the base plate 160 (FIG. 7) and extend upward approximately normal to the upper surface of the platform 13. The adjustment screws 164 are threaded into the top of the pillars 162 such that rotation of the adjustment screws causes them to be threaded into and out of the pillars 162. The axle supports 168 are mounted on the top of the screws 164. Rotation of the screws 164 moves the axle supports up and down in order to align the axle supports with the axles of the wheels 20 of the wheelchair as described below.

Figure 7:
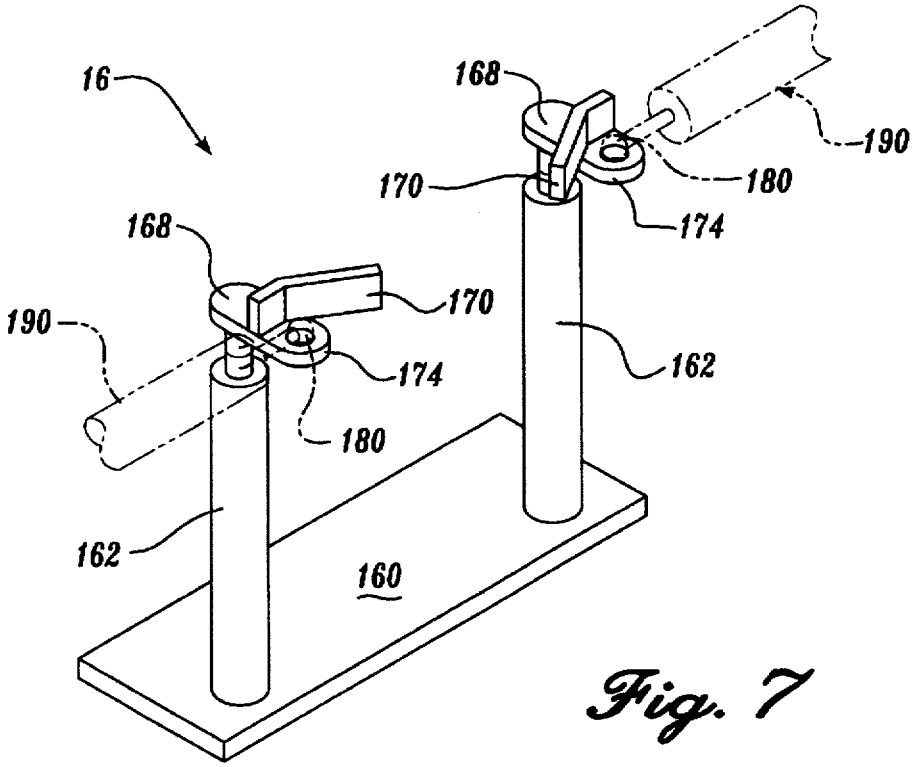
FIG. 7 is a perspective view of a portion of the wheelchair support.

Each axle support 168 extends forward from the top of the screws 164. Each axle support includes a centering guide wall 170. The centering guide walls 170 slope inward and forward from the top of the screws 164 as seen in FIG. 7. A ball support 174 is mounted to each axle support 168 adjacent the portion of the guide walls 170 that is connected to the axle supports. The ball supports 174 support balls 180 that are attached to the axles of the wheelchair 22 as described below.

The wheelchair trainer 10 also includes opposing guide walls 182 (FIG. 3). The guide walls 182 are mounted on the upper surface of the platform 13 and slope inward from their right end to their left end as best seen in FIG. 3. The guide walls 180 help to guide the wheelchair 22 into the proper position to be locked into the wheelchair trainer during insertion as described in more detail below.

Prior to using the wheelchair 22 within the wheelchair trainer 10, support nuts 190 (FIG. 2) are placed on the interior end of the axles 192 of the wheelchair as illustrated in FIG. 2. Although wheelchairs differ in size, shape and configuration, generally the wheels 20 of the wheelchair are mounted to the frame of the wheelchair through the use of axles that are connected to the frame of the wheelchair. In order to allow adjustment, the axles 192 are generally mounted within adjustment plates (not shown) that allow the position and slant of the axles relative to the horizontal to be adjusted. The axles 192 extend through the frame of the wheelchair, as illustrated in FIG. 2, and have a free threaded interior end. Each support nut 190 includes a ball 180 at its inner end. The balls 180 are supported within the ball supports 174 when the wheelchair 22 is fully inserted into the wheelchair trainer as described below.

Prior to first using a particular wheelchair 22 with the wheelchair trainer 10, it is advantageous to adjust the wheelchair support mechanism 16. The wheelchair support mechanism 16 is adjusted by loosening the connection between the axle supports 168 and the screws 164. The height and relative positions of the axle supports 168 are then adjusted so that the ball supports 174 are positioned at the same distance apart as the balls 180 mounted on the interior of the wheelchair's axles 192. Thus, when fully inserted into the wheelchair trainer 10, the balls 180 will rest firmly within the ball supports 174 as illustrated in FIG. 7. The height at which each axle support 168 is located is also adjusted by threading the screws 164 into or out of the pillars 162. After the axle supports 168 are adjusted, they are locked into place and the wheelchair trainer 10 is ready for use.

During use, a wheelchair occupant backs the wheelchair 22 up the individual steps 24–28 of the ramp 12, as described above. After the wheels 20 of the wheelchair 22 are positioned on top of the platform 13, the wheelchair occupant continues to move the wheelchair rearward as illustrated by arrow 200 (FIG. 3). As the wheels 20 of the wheelchair 22 continue to move rearward, the outside edges of the wheels contact the inner sides of the guide walls 182. The inward sloping guide walls 182 center the wheels 20 and thus wheelchair trainer 22 or so that the balls 180 are positioned correctly to move rearward into the axle supports 168.

As the wheelchair 22 continues to move rearward, the wheels 20 move into contact with the front of the lift bar 36. Generally, at this time, the lift bar or retractable stair 36 will be in a raised position approximately ¾ inches to 1 inch above the surface of the platform. The wheelchair occupant continues to roll the wheelchair 22 rearward so that the wheels 20 of the wheelchair climb onto the raised lift bar 36. Thus, the retractable stair or lift bar raises the rear wheels 20 of the wheelchair off of the platform 13 so that they are correctly positioned to move rearward into the support mechanism 16.

After the rear end of the wheelchair is raised, the occupant stops the rotation and moves the wheelchair 22 rearward again. As the wheelchair 22 continues to move rearward, the balls 180 contact the guide walls 170 and are centered into position directly over the ball supports 174. The occupant then rotates the crank handle 44 in a direction to cause the lift bar 36 to move downward and the balls 180 to be deposited onto and supported by the ball supports 174. The wheelchair occupant continues to lower the lift bar 36 until it does not contact the wheels 20.

The wheelchair occupant then adjusts the position of the roller 70 by adjusting the opposing handles 92. Turning the handles 92 causes the opposing ends of the roller 70 to be moved upward or downward as described above thus adjusting the rolling resistance provided by the roller 70. The wheelchair occupant adjusts the rolling resistance between the roller 70 and wheels 20 in order to achieve the desired resistance. Generally, only sufficient resistance is placed between the wheels 20 and the roller 70 to minimize or eliminate slip between the wheels and roller during use of the wheelchair trainer. Excessive amounts of resistance between the roller 70 and wheels 20 may result in poor operation of the wheelchair trainer by causing the wheels 20 to be too difficult to be turned or by limiting movement of the wheels after the wheelchair occupant lets go. It is advantageous that the resistance between the roller 70 and wheels 20 be adjusted to simulate actual use of the wheelchair. The invention'stability to individually adjust both ends of the roller 70 allows the wheelchair occupant to account for slight variations in wheel size and tire pressure etc., in order to achieve the most advantageous results.

After the position of the roller 70 is adjusted, the wheelchair trainer 10 is ready for use. Under typical operation, the roller 70 will only need to be adjusted as the wheelchair occupant becomes more physically fit, and thus requires less slippage between the roller 70 and wheels 20. As the wheelchair occupant rotates the wheels 20, it causes the roller 70 to rotate. Rotation of the roller 70 in turn rotates the drive pulley 72, drive belt 74 and driven pulley 76. As the driven pulley 76 rotates, it rotates the eddy current brake.

As described briefly above, the eddy current brake 110 is connected to the controller 144 and a display 146 and modem 148. A wheelchair occupant can program various resistances into the load mechanism 82 using the controller 144. As discussed above, by adjusting the current to the eddy current brake 110, the controller 144 is able to adjust the resistance required to rotate the eddy current brake and thus rotate the roller 70. Therefore, the wheelchair occupant may program the controller 144 to adjust the resistance to movement of the wheels 20 of the wheelchair. For example, the wheelchair occupant can program the resistance produced by the roller to simulate movement over level terrain, movement up a steady incline, a variable incline, etc. The wheelchair occupant can also program a specific race course, etc., into the controller.

In the preferred embodiment, it is advantageous to connect the controller to the display 146. The controller 144 can either display information regarding the output of the wheelchair occupant, for example, calories per hour, etc., or it can be used to provide a visual indication of how well the wheelchair occupant is performing. As is well known in the art, the controller 144 can measure the performance of the wheelchair occupant by measuring the speed or distance of rotation of the wheels of the wheelchair through use of a means such as an optical encoder mounted on any of the rotating members of the wheelchair trainer. For example, the controller 144 can include software that provides the wheelchair occupant a moving picture showing the progress of the wheelchair occupant over a race course, etc. The controller 144 can also provide a display of how the wheelchair occupant is doing with respect to a preprogrammed competitor on a race course to provide motivation to exercise.

In the preferred embodiment, the controller is also connected to the modem 148 and a phone line 152. With the proper software, the wheelchair occupant may participate in simulated races with other wheelchair occupants having a compatible wheelchair trainer. In a manner well known in the art, the controller 144 exchanges information with the controller used by the wheelchair occupant on the other end of the phone line 152. Thus, the controller 144 can provide the wheelchair occupant a visual indication of competitive position with respect to the opposing wheelchair occupant. The software can also simulate draining behind the opposing wheelchair occupant by adjusting the resistance to rotation of the wheels 20 provided by the load mechanism 82.

After completion of the aerobic exercising, the wheelchair occupant disengages the wheelchair 22 from the wheelchair trainer 10. First the wheelchair occupant rotates the handle 44 in order to raise the lift bar 36 and thus wheels 20. The raising of the wheels 20 lifts the balls 180 out of the ball supports 174, thus disengaging the wheelchair from the support mechanism 16. The wheelchair occupant then rolls the wheelchair forward until the balls 180 are disconnected from the balls supports 174 and axle supports 168. The wheelchair occupant then rolls the wheelchair forward off of the lift mechanism 36 and out of the wheelchair trainer 10.

Alternatively to the discussion of the operation of the wheelchair trainer 10, it may be advantageous in some situations to use the lift mechanism 14 to raise the wheelchair to the proper heights so that it engages the support mechanism 16. Such a situation may be advantageous, for example, if the wheelchair occupant is having trouble rolling the wheelchair onto the i mechanism 36 when it is in its raised position. In such an application, the wheelchair occupant would proceed as discussed above to enter the wheelchair trainer 10 by rolling the wheelchair up the ramp 12. However, in this scenario the wheelchair lift mechanism 14 would be in its lowered position. The wheelchair occupant would then roll the wheelchair rearward until the wheels 20 were positioned on top of the lift bar 36. The wheelchair occupant then rotates the crank handle 44 causing the lift bar 36 to move the rear position of the wheelchair upward as described above. After the rear end of the wheelchair is moved upward, the wheelchair occupant continues to rotate the wheelchair rearward so that the balls 180 mounted on the wheels 20 are moved into the ball supports 174. The wheelchair occupant would then lower the lift mechanism in the same manner as that described above. If the wheelchair occupant was concerned about rolling forward off of the raised lift mechanism 14, the wheelchair occupant could also use the lift mechanism to lower the wheelchair onto the top surface of the platform 13 by rotating the crank handle 44 in the proper direction.

Figure 8:
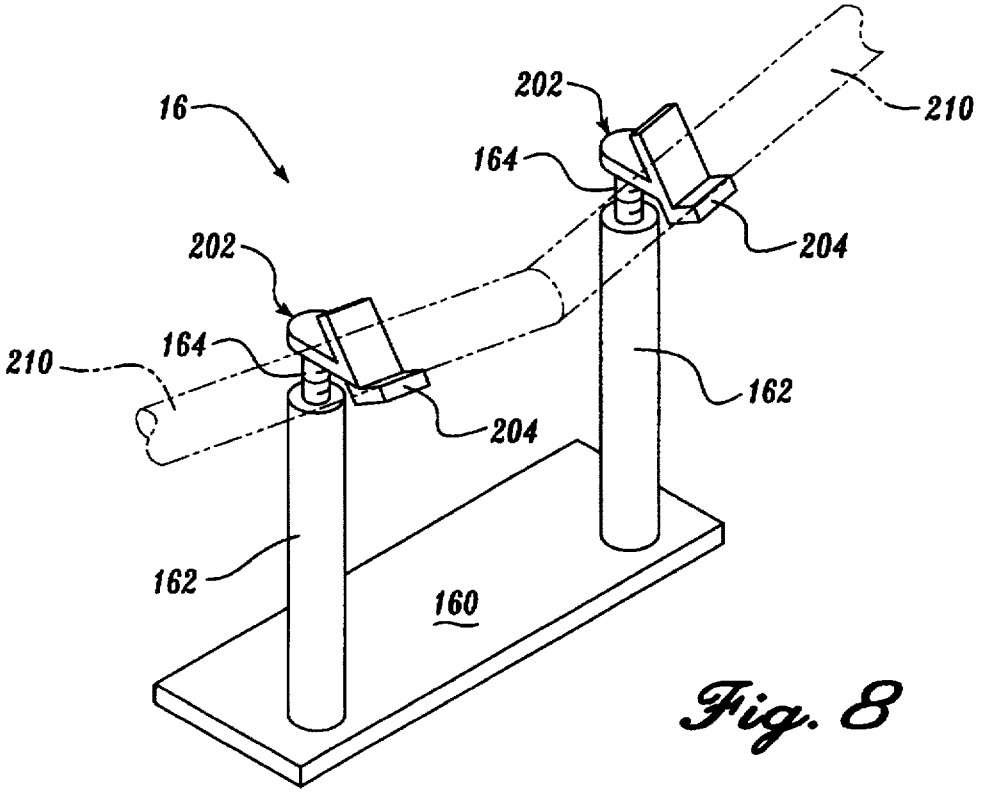
FIG. 8 is a perspective view of an alternate embodiment of a wheelchair support according to the invention.

Although the axle supports 168 support the majority of wheelchair configurations, they do not support all wheelchair configurations. For wheelchair configurations that use axles or supports that extend across the width of the wheelchair a different support mechanism is used. As illustrated in FIG. 8, such wheelchair configurations may be supported with axle supports 202 that use V-shaped support brackets 204. When support brackets 204 are used, the wheelchair occupant goes through the same basic steps of inserting the wheelchair into the wheelchair trainer as described above. However, instead of lowering the balls attached to the axles of the wheelchair into the axle supports 202, the axles or flame 210 of the wheelchair are lowered into the V-shaped support brackets 204. Otherwise, the operation and configuration of the wheelchair trainer 10 does not differ from that described above.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An aerobic wheelchair trainer comprising:

a platform that receives a wheelchair and wheelchair occupant;

a support mechanism coupled to the platform and wheelchair to support the weight of the wheelchair and wheelchair occupant; and a load mechanism that engages the wheels of the wheelchair and provides a variable resistance to rotation of the wheels of the wheelchair, the load mechanism including a roller and a mechanism for moving the roller into contact with at least one of the wheels with a varying force to adjust the magnitude of rolling resistance between the roller and the wheel.

2. The wheelchair trainer of claim 1, further comprising a ramp attached to the front of the platform that allows the wheelchair occupant to maneuver the wheelchair up the ramp onto the platform.

3. The wheelchair trainer of claim 2, wherein the ramp includes a plurality of level on which the wheelchair may rest in an immobile state as the wheelchair is moved up or down the ramp.

4. The wheelchair trainer of claim 3, wherein opposite ends of the roller engage opposing wheels of the wheelchair and wherein the ends of the roller can be independently adjusted to adjust the amount of force placed on the individual wheels of the wheelchair by each end of the roller.

5. The wheelchair trainer of claim 1, wherein the support mechanism further comprises pillars that extend upward from the surface of the platform, the pillars including axle supports that support the axles of the wheelchair.

6. The wheelchair trainer of claim 1, wherein the support mechanism further comprises pillars that extend upward from the surface of the platform and that support the frame of the wheelchair.

7. The wheelchair trainer of claim 5, wherein the support mechanism further comprises support balls attached to the axles of the wheelchair and wherein the axle supports include ball supports to support the support balls.

8. The wheelchair trainer of claim 1, further comprising a lift mechanism for allowing the wheelchair occupant to, maneuver the wheelchair into or out of the support mechanism without the help of another person, the lift mechanism further comprises a lift bar that is located under the wheels of the wheelchair and that may be moved up or down in order to raise or lower the wheelchair.

9. The wheelchair trainer of claim 8, further comprising lift arms that are pivotally attached to the platform and the lift bar so that rotation of the lift arms moves the lift bar up and down.

10. The wheelchair trainer of claim 1, further comprising guide walls that extend upward from the surface of the platform and inward to position the wheelchair in the proper position as the wheelchair is moved rearward onto the platform.

11. The wheelchair trainer of claim 1, wherein the load mechanism further comprises an eddy current brake that provides a variable resistance to rotation of the wheels of the wheelchair.

12. The wheelchair trainer of claim 11, wherein the load mechanism further comprises a controller and display that are connected to the eddy current brake, the controller being adjustable by the wheelchair occupant to provide a varying current to the eddy current brake and thus a varying resistance to rotation of the wheels of the wheelchair.

13. The wheelchair trainer of claim 12, further comprising a means for measuring the speed or distance of rotation of the wheels of the wheelchair, wherein the controller receives a signal from the measuring means and provides a signal to the display to provide the wheelchair occupant interactive feedback indicative of the performance on the wheelchair trainer.

14. The wheelchair trainer of claim 13, further comprising a modem connected to the controller and to a phone line, the modem providing the controller with information from a wheelchair trainer located on the opposite end of the phone line to allow the controller to provide the wheelchair occupant an indication of performance with respect to another wheelchair occupant using the wheelchair trainer at the opposite end of the phone line.

15. An aerobic wheelchair trainer comprising:

a platform adapted to receive a wheelchair;

a support mechanism coupled to the platform to support the majority of the weight of the wheelchair and a wheelchair occupant;

a lift mechanism comprising a lift bar that is located under the wheels of the wheelchair and that may be moved up or down in order to raise or lower the wheelchair so that a wheelchair occupant may maneuver the wheelchair into the support mechanism without the help of another person; and a load mechanism that engages the wheels of the wheelchair and provides a variable resistance to the rotation of the wheels.

16. The wheelchair trainer of claim 15, further comprising lift arms that are pivotally attached to the platform and the lift bar so that rotation of the lift arms moves the lift bar up and down.

17. The wheelchair trainer of claim 15, wherein the support mechanism further comprises pillars that extend upward from the surface of the platform, the pillars including axle supports that support the axles of the wheelchair.

18. The wheelchair trainer of claim 15, wherein the support mechanism further comprises pillars that extend upward from the surface of the platform and that support the frame of the wheelchair.

19. The wheelchair trainer of claim 17, wherein the support mechanism further comprises support balls attached to the axles of the wheelchair and wherein the axle supports include ball supports to support the support balls.

20. The wheelchair trainer of claim 15, wherein the load mechanism further comprises an eddy current brake that provides a variable resistance to rotation of the wheels of the wheelchair.

21. The wheelchair trainer of claim 15, further comprising a ramp attached to the front of the platform that allows the wheelchair occupant to maneuver the wheelchair up the ramp onto the platform, the ramp having a plurality of level steps on which the wheelchair may rest in an immobile state as the wheelchair is maneuvered up or down the ramp.

22. An aerobic wheelchair trainer, comprising:

a platform adapted to receive a wheelchair;

a ramp attached to the front of the platform and including a plurality of level steps that allow a wheelchair occupant to maneuver a wheelchair up the ramp onto the platform by maneuvering the wheelchair up the plurality of level steps such that the occupant may release the wheels of the wheelchair and the wheelchair wheels will remain on the respective level steps without the wheelchair rolling down the ramp;

a support coupled to the platform and the wheelchair when the wheelchair is positioned on the platform to support the majority of the weight of the wheelchair and wheelchair occupant; and a load mechanism that engages the wheels of the wheelchair and provides a varying resistance to the rotation of the wheels.

23. The wheelchair trainer of claim 22, wherein the support further comprises pillars that extend upward from the surface of the platform and that include axle supports that attach to and support the axles of the wheelchair.

24. The wheelchair trainer of claim 23, wherein the support further comprises ball supports that support balls that are attached to the axles of the wheelchair.

25. The wheelchair trainer of claim 22, further comprising a lift bar located under the wheels of the wheelchair when the wheelchair is resting on the platform and that is movable up and down and that raises or lowers the wheelchair so that the wheelchair occupant may maneuver the wheelchair into the support without the aid of another person.

* * * * *

UNITED STATES PATENT AND TRADEMARK OFFICE

CERTIFICATE OF CORRECTION

PATENT NO. : 5,704,876
DATED : January 6, 1998
INVENTOR(S) : W. Baatz

It is certified that error appears in the above-indentified patent and that said Letters Patent is hereby corrected as shown below:

| COLUMN | LINE | ERROR |
|---|---|---|
| [73] Pg. 1, col. 1 | Assignee | "Seattle, Mass." should read --Seattle, Wash.-- |
| [56] Pg. 1, col. 1 | Refs. Cited (Other Publs., Item 1) | "Veterens" should read --Veterans-- |
| [56] Pg. 1, col. 2 | Refs. Cited (Other Publs., Item 2) | "INc.," should read --Inc.,-- |
| Pg. 1, col. 2 | Attorney, Agent, or Firm | After "O'Connor" delete ";" |
| 12 (Claim 3, | 29 line 2) | After "level" insert --steps-- |
| 12 (Claim 4, | 32 line 1) | "opposite" should read --opposing-- |
| 12 (Claim 8, | 49 line 2) | After "occupant to" delete "," |

UNITED STATES PATENT AND TRADEMARK OFFICE

CERTIFICATE OF CORRECTION

PATENT NO. : 5,704,876

DATED : January 6, 1998

INVENTOR(S) : W. Baatz

It is certified that error appears in the above-indentified patent and that said Letters Patent is hereby corrected as shown below:

| COLUMN | LINE | ERROR |
|---|---|---|
| 13 (Claim 12, | 2-3 lines 2-3) | After "controller" delete "and display that are" and insert therefor --that is-- |

Signed and Sealed this

Seventh Day of April, 1998

Bruce Lehman

*Attest:*

BRUCE LEHMAN

*Attesting Officer*

*Commissioner of Patents and Trademarks*